US008534860B2

(12) United States Patent
Chen

(10) Patent No.: US 8,534,860 B2
(45) Date of Patent: Sep. 17, 2013

(54) DISPLAY LIGHT BOX WITH PROGRAMMABLY SEPARATELY-LIT COMPARTMENTS

(76) Inventor: David Chen, Arcadia, CA (US)

( * ) Notice: Subject to any disclaimer, the term of this patent is extended or adjusted under 35 U.S.C. 154(b) by 440 days.

(21) Appl. No.: 12/957,874

(22) Filed: Dec. 1, 2010

(65) Prior Publication Data

US 2012/0139441 A1 Jun. 7, 2012

(51) Int. Cl.
*G09F 13/04* (2006.01)

(52) U.S. Cl.
USPC ..... 362/97.4; 362/97.1

(58) Field of Classification Search
USPC ..... 362/97.1, 97.4
See application file for complete search history.

(56) References Cited

U.S. PATENT DOCUMENTS 4,511,953 A 4/1985 Fage
4,929,936 A 5/1990 Friedman
5,573,328 A 11/1996 Hwang
6,042,243 A 3/2000 Grill et al.
6,823,618 B2 11/2004 Huang
7,086,769 B1 8/2006 Thompson et al.
7,278,770 B2 10/2007 Lu
7,766,536 B2 8/2010 Peifer
7,813,002 B2 * 10/2010 Schori ..... 358/1.9
2006/0056170 A1 * 3/2006 Todorovic et al. ..... 362/97
2009/0073673 A1 * 3/2009 Young ..... 362/97.1

* cited by examiner

*Primary Examiner* — David V Bruce

(57) ABSTRACT

The present invention is a display light box comprising several compartments with partitioning walls shaped according to a translucent image on a frontal display panel. The compartments are illuminated by LEDs, which are installed a distance away from the picture panel to accomplish uniformity of the light on the panel, and driven by a controller so the LEDs may be turned on and off in any pre-determined sequence, accomplishing a changing presentation and thereby making the light box more attractive. The intensity of each compartment may be designed to be different, by the number of LEDs installed in the compartment or by the number of LEDs turned on at any given moment. In addition, LEDs in the same compartment may be turned on and off in certain pattern, accomplishing additional artistic impression.

17 Claims, 4 Drawing Sheets

DISPLAY LIGHT BOX WITH PROGRAMMABLY SEPARATELY-LIT COMPARTMENTS

FIELD OF THE INVENTION

The present invention relates to display light box.

BACKGROUND OF THE INVENTION

Traditional light boxes comprise one or more compartments, uniformly and statically lit. U.S. Pat. Nos. 6,042,243, 6,823,618, 7,766,536, and 5,573,328 proposed several typical designs of the kind.

U.S. Pat. No. 4,511,953 proposed a light box with parallel secondary walls dividing the compartments and with a pivotally engaged cover. When graphic is displayed, such as in U.S. Pat. No. 7,278,770, a single uniform light source illuminates the entire panel.

When various portions of the display need to be illuminated in sequence, neon lights are widely used. Compared to LEDs, the graphical representations using neon lights are less complex. In addition, the neon lights consume more electricity and are hard to repair.

LEDs themselves are used as displays directly in some designs (U.S. Pat. Nos. 4,929,936 and 7,086,769).

The present design unitizes LEDs and a controller to allow a color graphic image to be illuminated region by region in any sequence and at various light intensities and patterns (by turning on and off the LEDs in the compartment at a certain pattern) to attract viewers' attention to various parts of the image, as well as the light box as a whole.

SUMMARY OF THE INVENTION

The present invention comprises several compartments with partitioning walls shaped according to a translucent image on a frontal display panel, and illuminated by LEDs installed a certain distance back from the frontal display panel on a back panel onto which the partitioning walls are installed to accomplish the uniformity of light on the frontal display panel. The type and number of LEDs are determined by the required light intensity level of the translucent image.

LEDs are driven by a programmable controller which turns on and off the LEDs in any predetermined sequence to present a changing artistic display.

The light box comprises a frontal frame and a body, which further comprises four side walls and a back wall. Although the back panel and the back wall are separate in the preferred embodiment, the back wall could be used as the back panel. The frontal frame and the body are made of appropriate materials according to the location where the light box is installed, e.g., indoors vis-à-vis outdoors. A rubber frame is placed between the frontal frame and the body.

The surfaces of the partitioning walls and the inside surfaces of the side panels and the back panel, where the LEDs are installed, comprise light reflective materials to reduce the absorption of light by the surfaces, in order to increase the efficiency of the light box.

The LEDs and the controller are powered by a power source.

DETAILED DESCRIPTION OF THE INVENTION

Figure 1:
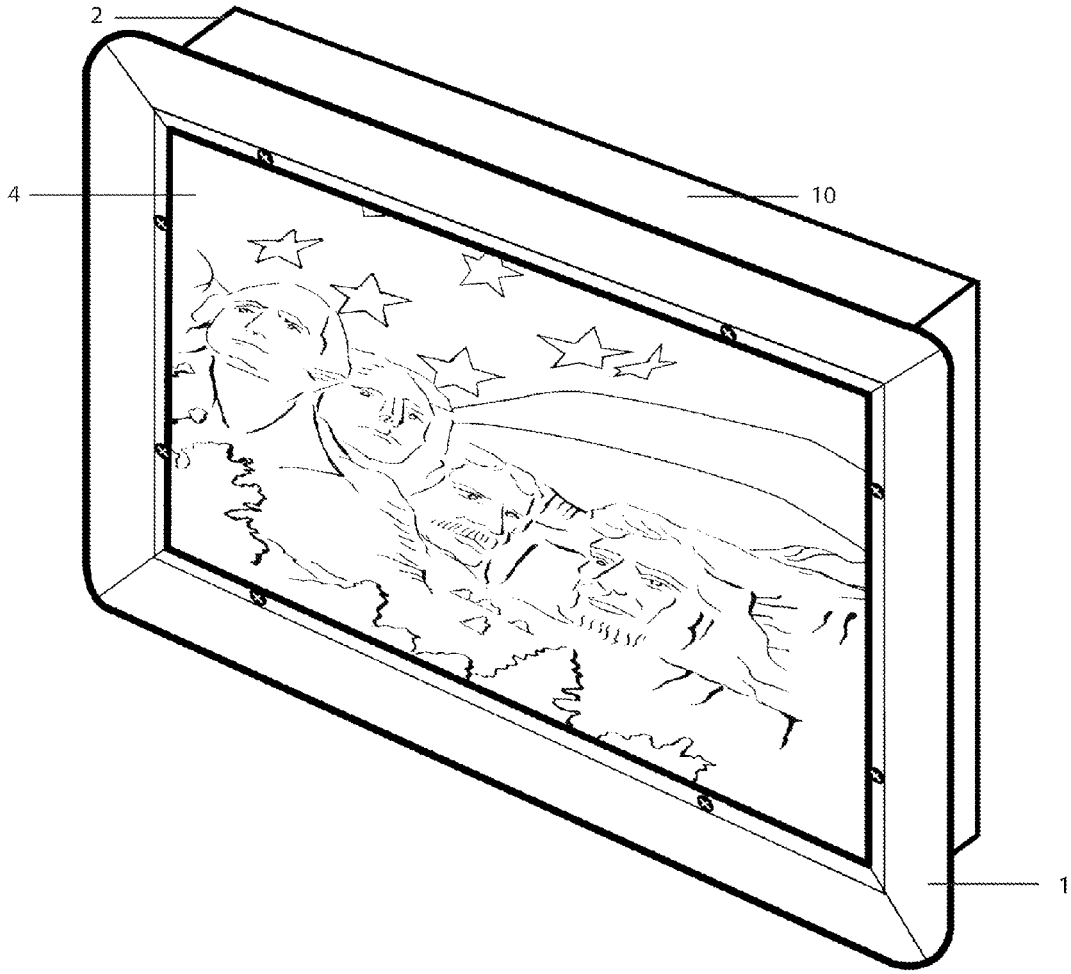
FIG. 1 is a perspective view of the light box.
Figure 2:
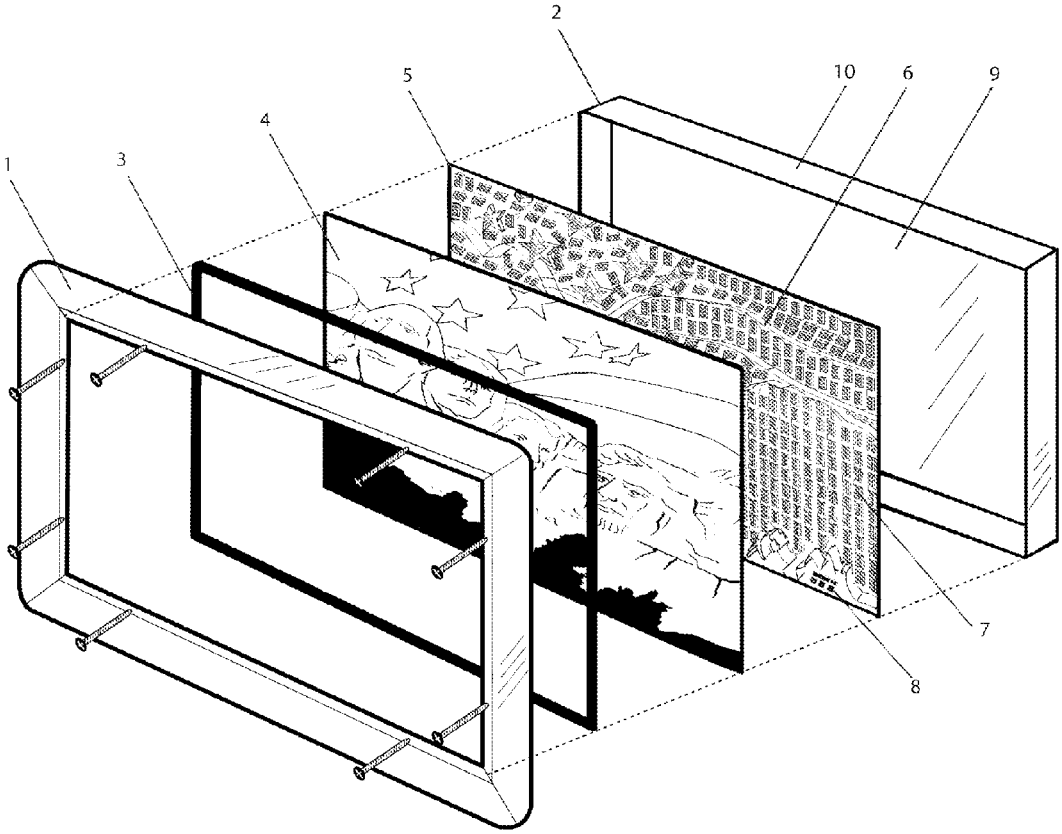
FIG. 2 is an exploded view of the light box.

FIG. 1 and FIG. 2 show the present invention comprising a frontal frame 1, a body 2, a rubber ring 3, a frontal display panel 4, a back panel 5, partitioning walls 6, LEDs 7, and a controller 8. The body comprises a back wall 9 and four side walls 10. In alternative embodiments, the back wall could also be used as the back panel. Or, four separate side panels may be used inside the four side walls.

The frontal display panel 4 comprises a translucent image. In the preferred embodiment, the frontal display panel 4 comprises the translucent image sheet, attached to the inside of the transparent frontal display panel 4. The translucent image is divided into several regions. Partitioning walls 6 are installed along the edges of the regions. Therefore, the LEDs in each region only illuminate the corresponding region. According to the artistic design, LEDs are turned on and off in certain patterns to accomplish a changing artistic view.

Figure 3:
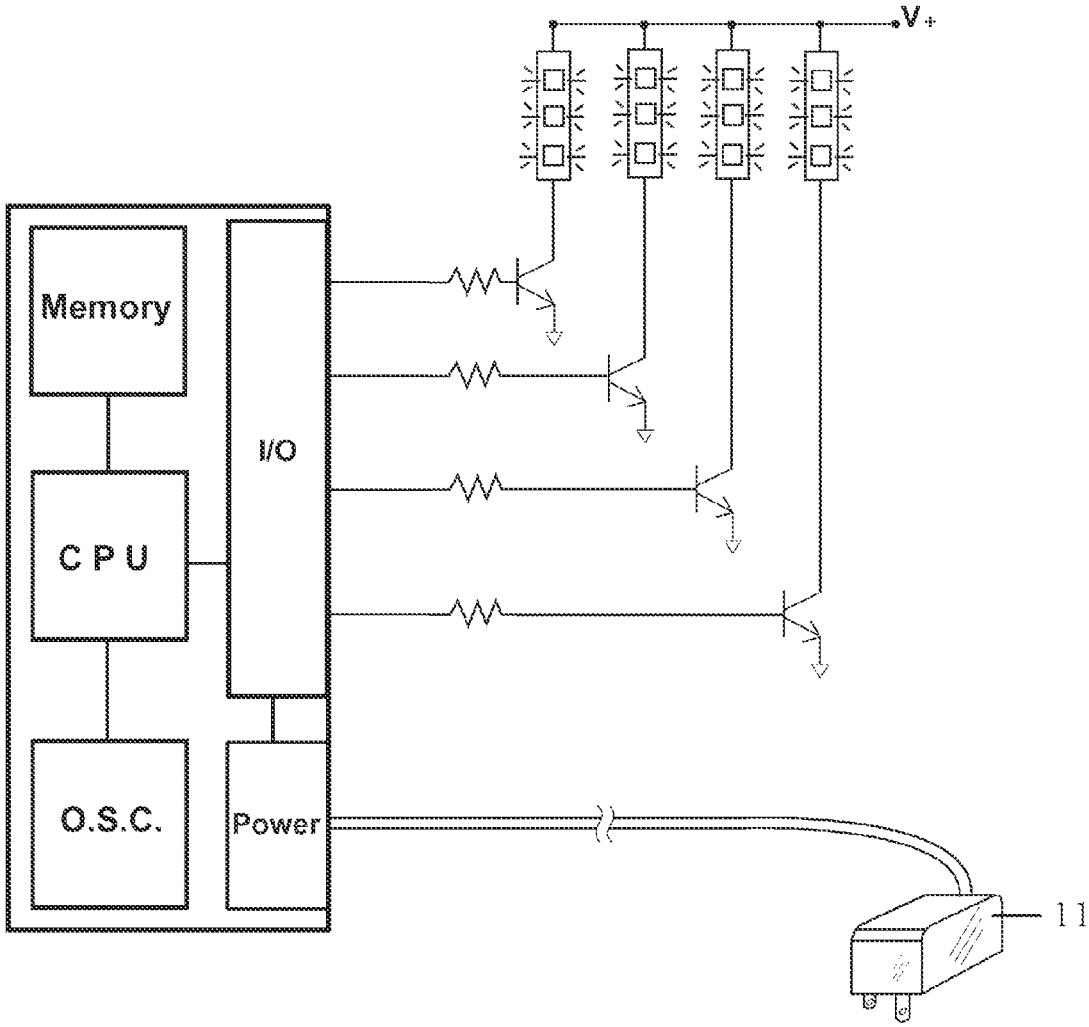
FIG. 3 is the block diagram of the electronic circuit.

The light box can be powered by any power source, including 110VAC power, rechargeable batteries, or rechargeable batteries with one or more solar panels. In one of the preferred embodiments, as shown in FIG. 3, 110VAC power is converted to 12VDC which is supplied into the controller.

The surfaces of partitioning walls 6 and the inside surfaces of the back panel 5 and four side walls 10 are made of light reflective materials to enhance the efficiency of LEDs and accomplish more uniform light on the frontal display panel 4. In a preferred embodiment, the back panel 5 and four side walls 10 are made of polished aluminum plates, which reflex light and also conduct heat.

Figure 6:
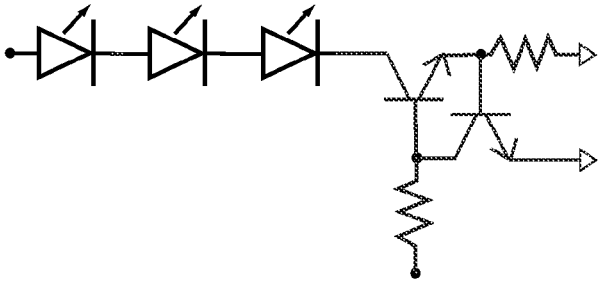
FIG. 6 shows an alternative preferred design of the LED unit where electrical current is regulated by transistor circuits.
Figure 5:
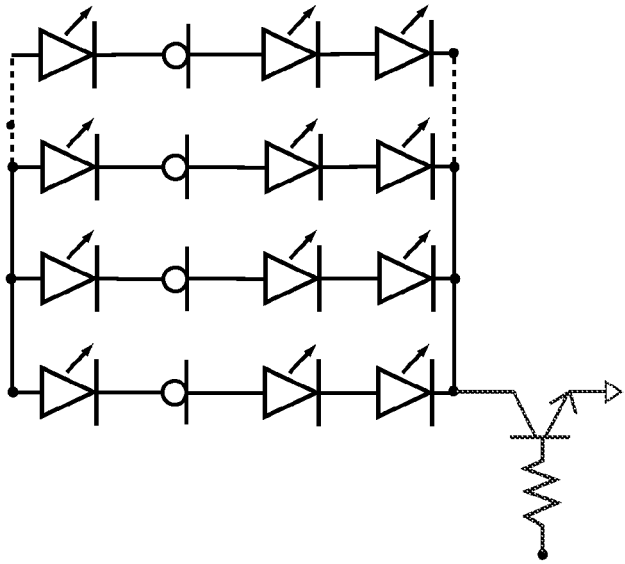
FIG. 5 shows the preferred design of the LED units where electrical current is regulated by CRDs.
Figure 4:
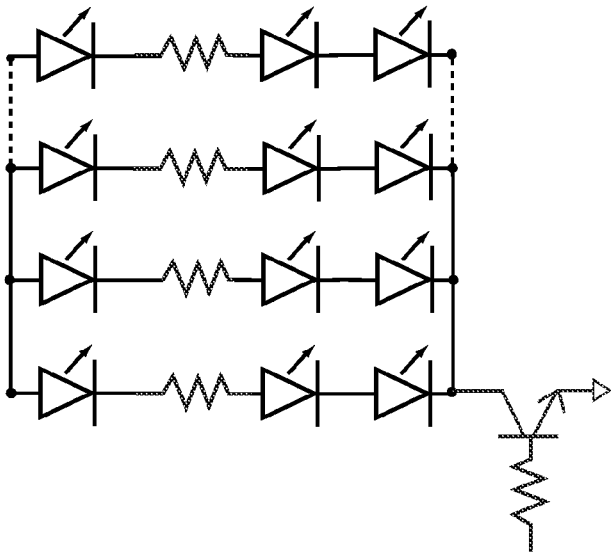
FIG. 4 shows the traditional design of the LED units where electrical current is regulated by resistors.

The partitioning walls 6 separate individual compartments so they can be illuminated separately. In the best embodiment, the partitioning walls 6 are made of thin reflective metal sheets. The LEDs 7 can be affixed to the back panel 5 by any replaceable means, such as fasteners (e.g., screws, clips, etc.) or adhesives (e.g., silicone glue). Several LEDs can be connected together in series with a regulator, which could be a resistor (FIG. 4), a CRD (Current Regulative Diode) (FIG. 5), or a transistor circuit (FIG. 6), to form a LED unit, and then connected in parallel (FIGS. 3, 4, 5) to the I/O port (FIG. 3) of the controller 8.

In the resistor design (FIG. 4), resistors consume power. In addition, the resistance varies according to the ambient temperature, which, for an out-door sign, could range from burning summer to freezing winter. Using CRDs or transistor circuits as regulators saves power.

For artistic effects, for example, LEDS in the same compartment may be separated into different groups to make the light intensity changeable. Alternatively, LEDs in the same compartment may be turned on and off in certain patterns to create certain visual effect (e.g., turned on and off row by row to create a flowing visual effect).

The material of the frontal frame 1 and the body 2 can be selected according to the location where the light box is installed (e.g., indoors vis-à-vis outdoors).

FIG. 3 shows the diagram of the controller. The standard power converter 11 of sufficient amperage capacity converts 110VAC to 12VDC which powers both the controller and the LEDs. The controller comprises an oscillator, a central processing unit, a memory unit, and I/O port. According to programs and data stored in the memory unit, the central processing unit controls I/O port, which supplies power to the LEDs 7.

When the light box is used in certain places, such as on a shop window or as a free-standing outdoor sign, it may be desirable to make it double-sided by attaching two light boxes back to back. For instance, when a double-sided light box is used on shop window, it may be desirable to use a traditional static design on the inside so customers would not be distracted, and use the present invention facing outside to attract the attention of passers-by. When a double-sided light box is used in the free-standing outdoor sign, it may be preferable for both sides to use the present invention.

What is claimed is:

1. A light box comprising

A frontal display panel whereon a translucent image is separated into several regions;

Several partitioning walls that are attached to the division lines of the regions on the frontal display panel;

Several LEDs to be affixed behind the frontal display panel; and

A controller that supplies power to the LEDs.

2. The light box of claim 1 further comprising a back panel on which the LEDs are affixed.

3. The light box of claim 2 further comprising a body comprising a back wall and four side walls.

4. The light box of claim 2 wherein the LEDs are replaceably affixed to the back panel.

5. The light box of claim 2 wherein the inside surface of the back panel is made of light reflective materials.

6. The light box of claim 1 wherein the surfaces of the partitioning walls are light reflective.

7. The light box of claim 1 wherein the surfaces of the partitioning walls are made of polished thin metal sheets.

8. The light box of claim 1 wherein the LEDs comprise multiple LED units connected in parallel, wherein each LED unit comprises several LEDs and a current regulator.

9. The light box of claim 8 wherein the current regulator is a resistor.

10. The light box of claim 8 wherein the current regulator is a CRD (Current Regulative Diode).

11. The light box of claim 8 wherein the current regulator is a transistors circuit.

12. The light box of claim 1 wherein the controller further comprises an oscillator, a central processing unit, a memory unit, and an I/O port.

13. The light box of claim 1 wherein 12VAC power is supplied into the unit.

14. The light box of claim 1 wherein power is supplied by rechargeable batteries.

15. The light box of claim 1 wherein power is supplied by rechargeable batteries coupled with a solar power source.

16. The light box of claim 1 with a conventional light box attached to its back to form a double-sided light box.

17. The light box of claim 1 with another light box of claim 1 attached to its back to form the double-sided light box.

* * * * *